United States Patent [19]

Krimsky et al.

[11] Patent Number: 4,948,061

[45] Date of Patent: Aug. 14, 1990

[54] FLYING SPLICE UNWINDER

[75] Inventors: Leonard C. Krimsky, Englewood, N.J.; Henk Van Rietschoten, Blooming Grove, N.Y.

[73] Assignee: Worldwide Converting Machinery, Allendale, N.J.

[21] Appl. No.: 238,033

[22] Filed: Aug. 29, 1988

[51] Int. Cl.[5] ..... B65H 19/18

[52] U.S. Cl. ..... 242/58.3

[58] Field of Search ..... 242/56 R, 56 A, 58, 242/58.1–58.6; 156/504

[56] References Cited

U.S. PATENT DOCUMENTS

| | | | |
|---|---|---|---|
| 3,655,143 | 4/1972 | Wallis | 242/58.3 |
| 3,904,142 | 9/1975 | Corse | 242/58.3 |
| 4,010,061 | 3/1977 | Tokuno | 242/58.3 X |
| 4,024,782 | 5/1977 | Kron et al. | 242/56 A X |
| 4,102,511 | 7/1978 | Krimsky et al. | 242/64 |
| 4,171,780 | 10/1979 | Bugnone | 242/56 A |
| 4,233,104 | 11/1980 | Fujishima et al. | 242/58.1 X |
| 4,238,261 | 12/1980 | Tetro | 156/504 X |
| 4,431,140 | 2/1984 | Tetro | 242/58 X |
| 4,593,867 | 6/1986 | Yamasaki et al. | 242/56 R X |
| 4,720,320 | 1/1988 | Niemi | 242/58.1 X |
| 4,743,335 | 5/1988 | Krappitz et al. | 242/58.5 X |

FOREIGN PATENT DOCUMENTS

| | | | |
|---|---|---|---|
| 2126564 | 3/1984 | United Kingdom | 242/56 A |

*Primary Examiner*—John M. Jillions

*Attorney, Agent, or Firm*—Shenier & O'Connor

[57] ABSTRACT

A turret unwinder in which a carriage mounted on the turret for movement between limit positions respectively adjacent first and second diametrically opposite winding axes supports a bumper roll for movement from a neutral position to respective fired positions in engagement with rolls on the winding axes and first and second knife bars adapted to be fired respectively to sever webs being unwound from rolls on the two axes.

33 Claims, 6 Drawing Sheets

22
26
194
64
66
10
70
28
60
62
74
30
A
68
56
58
B
72
196
40
54
52
32
38
42
18
12
20

202
S1A
204
200
1R
198
48
1R1
1R2
M
2R2
1R3
2R3
2R1
S3B
S2A
2R
112
208
214
CALC.
COMP.
206
212
210
216
218
LINE
TACH

FLYING SPLICE UNWINDER

FIELD OF THE INVENTION

The invention relates to an improved flying splice unwinder and, more particularly, to a turret unwinder in which the web splicing mechanism is carried by the turret.

BACKGROUND OF THE INVENTION

There are known in the prior art unwinders for controlling the feeding of a web material toward a process station, for example, at which an operation such as coating or the like is to be performed on the web. More specifically, there are known in the prior art turret unwinders in which a pair of generally diametrically opposite pairs of roll supports respectively carry the roll being unwound and receive the next roll to be unwound. In such systems, means are provided for joining the leading end of the new roll to the trailing end of the expiring roll. In order that the process with which the unwinder is being used not be interrupted, it is desirable that the splicing operation of attaching the leading end of the new roll to the trailing end of the expiring roll be carried out while the web is moving at line speed. There are further known in the prior art off turret splicers for accomplishing this operation. One such splicing mechanism is shown and described in U.S. Pat. No. 3,944,151 issued Mar. 16, 1976.

While off turret splicers of the type described hereinabove operate satisfactorily in attaching the trailing end of the expiring web to the leading end of the new roll at line speed, they incorporate a number of disadvantages. First, they are off machine devices so that an installation utilizing such a device occupies a relatively large space. Such installations are expensive. The splicing operation in use of such devices can only be accomplished at one position of the turret with which the splicer is associated.

SUMMARY OF THE INVENTION

One object of our invention is to provide an improved flying splice unwinder which does not require any off the turret mechanism.

Another object of our invention is to provide an improved flying splice unwinder in which the splicing apparatus is carried by the turret for movement therewith.

A further object of our invention is to provide an improved flying splice unwinder which is relatively inexpensive as compared with automatic splicing systems of the prior art.

Yet another object of our invention is to provide an improved flying splice unwinder which permits the splice to be made in any position of the turret of the unwinder.

Other and further objects of our invention will appear from the following description.

BRIEF DESCRIPTION OF THE DRAWINGS

In the accompanying drawings to which reference is made in the instant specification and which are to be read in conjunction therewith and in which like reference numerals indicate like parts in the various views.

DESCRIPTION OF THE PREFERRED EMBODIMENT

Figure 1:
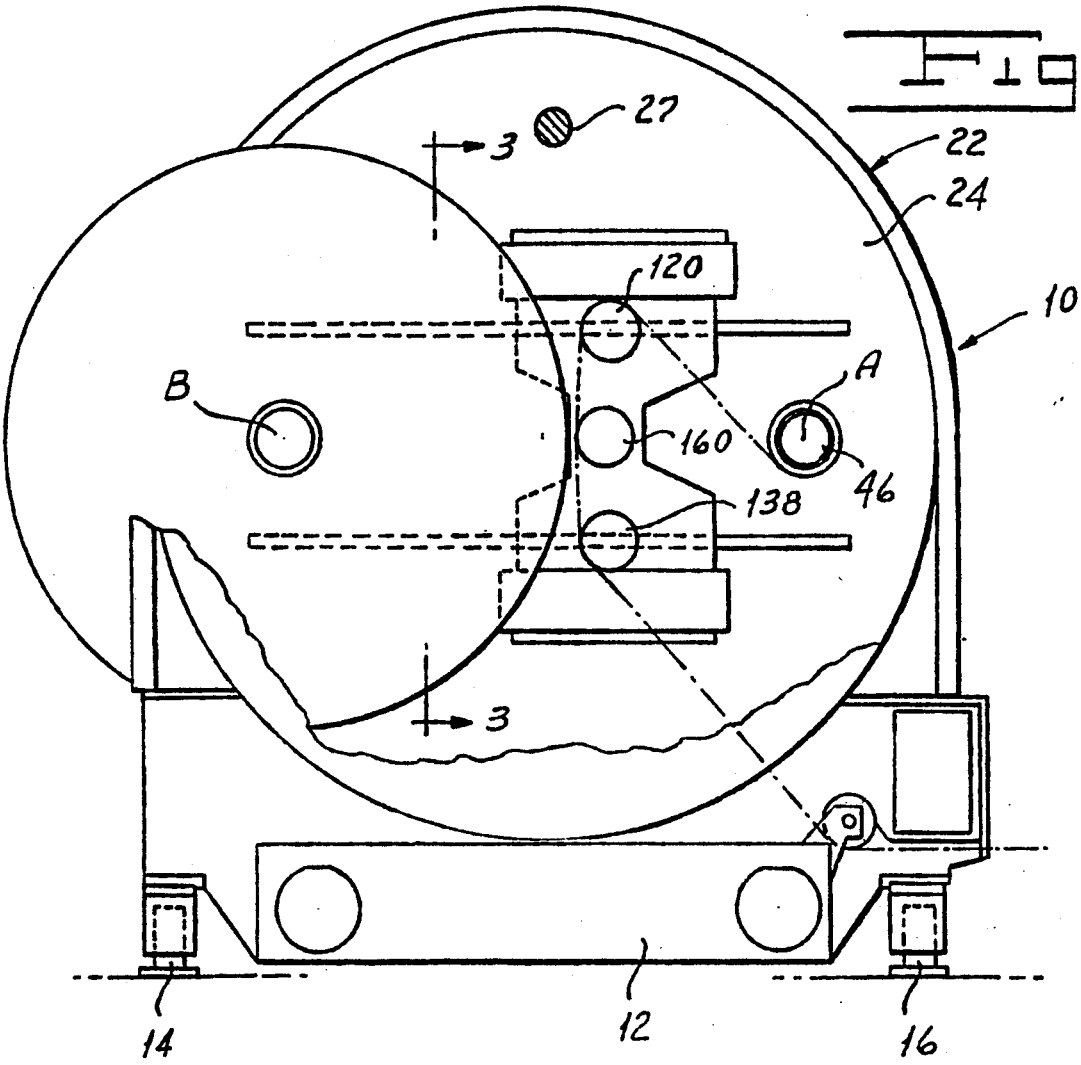
FIG. 1 is a front elevation of our flying splice unwinder.

Our flying splice unwinder includes a stand indicated generally by the reference character 10 having a rectangular base 12 supported on casters 14, 16, 18 and 20. The turret indicated generallY by the reference character 22 includes a pair of end gear plates 24 and 26 connected by suitable bars 27. The turret 22 is supported on the stand 10 for rotary movement around its central axis. Any suitable means known to the art may be employed to drive the turret. For example, a sprocket wheel 28 carried by one of the turret support shafts 30 is coupled by a pitch chain 32 to a sprocket wheel 42 on the output shaft 40 of a motor 38 on the stand 10. Suitable control means ensure that the turret is properly indexed in a manner well known in the art.

We mount pairs of roll core shaft supports 46 at pairs of diametrically spaced locations around the plates 24 and 26 with the respective pairs providing winding axes A and B at diametrically spaced locations around the turret 22. A drive motor 52 mounted on the outside of the plate 26 has a shaft 54 carrying a pulley 56 adapted to drive a belt 58 surrounding a pulley 60 on a shaft 62 so as to drive one pair of roll supports 46 to rotate the roll carried there by around the axis A, for example, when a new roll carried by the supports is to be driven up to line speed.

A second drive motor 64 carried by the outside of plate 26 has a shaft 66 carrying a pulley 68 adapted to drive a belt 70 surrounding a pulley 72 carried by a shaft 74. Shaft 74 is connected to one of the other pair of roll shaft supports 46 to rotate the associated roll around the axis B, for example.

Figure 3:
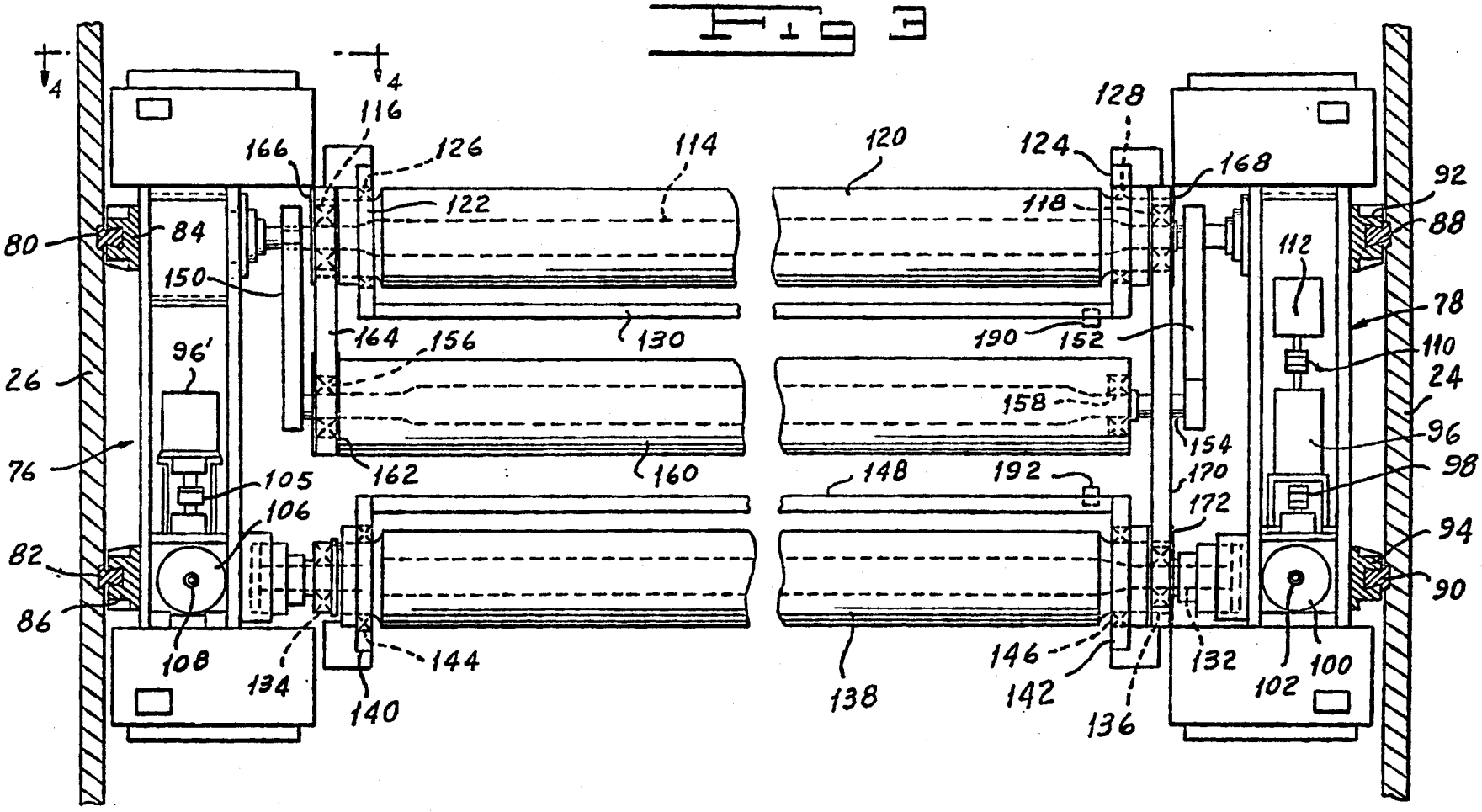
FIG. 3 is a section of our flying splice unwinder taken along the line 3—3 of FIG. 1.

Referring now to FIG. 3 of the drawings, our unwinder includes a left-hand carriage 76 and a right-hand carriage 78 which are mounted for movement as a unit and on the end plates 24 and 26 for rotation with the turret. A pair of left-hand dovetail guides 80 and 82 are mounted on the inner surface of plate 26 so as to extend along parallel chords at equal distances from the axis of rotation of the turret 22. A pair of slides 84 and 86 secured to the left-hand carriage 76 for movement therewith, receive the respective guides 80 and 82.

A second pair of dovetail guides 88 and 90 are mounted on the inside of the plate 24 along parallel chords equally spaced from the axis of rotation of the turret 22 and at locations corresponding to those of the guides 80 and 82. Slides 92 and 94 on carriage 78 receive the guides 88 and 90, respectively. While we have shown dovetail guides and slides for purposes of simplicity, preferably we use ball bushings to support the carriages 76 and 78 for sliding movement on the plates 26 and 24.

Carriage 78 supports a first drive motor 96 connected by a coupling 98 to a nut 100 carried by an elongated stationary screw 102 supported on the plate 24 and extending parallel to the guides 88 and 90. A second drive motor 96' on carriage 76 is connected by a coupling 105 to a nut 106 carried by an elongated stationary screw 108 secured to the inside of plate 26 and extending parallel to the guides 80 and 82.

Any suitable means known to the art may be employed to operate the drive motors on the respective carriages in synchronism so that nuts 100 and 106 are driven to move the carriages 76 and 78 along the associated guides 80 and 82 and 88 and 90. A coupling 110 connects motor 96 to a potentiometer 112 which, in a manner to be described, puts out a signal which is proportional to the position of the carriages 76 and 78 along their associated guides. Alternatively, only one motor and a suitable cross connection to the opposite carriage could be employed.

A first shaft 114 extending between and carried by the carriages 76 and 78 supports spaced bearings 116 and 118 which rotatably carry a first guide roller 120.

Respective first knife bar arms 122 and 124 are pivotally supported by bearings 126 and 128 carried by the roll 120. The first knife bar 130 is secured to corresponding ends of arms 122 and 124 for movement therewith.

A second shaft 132 extending between and secured to the carriages 76 and 78 receives respective bearings 134 and 136 at spaced locations rotatably to support the second guide roll 138 on the carriages for movement therewith.

A pair of second knife bar arms 140 and 142 carried by bearings 144 and 146 on the roll 138 support the second knife bar 148 for swinging movement around the axis of guide roll 138.

Corresponding ends of a pair of bumper roll arms 150 and 152 are pivotally carried on shaft 114. The ends of arms 150 and 152 remote from the shaft 114 receive the ends of a bumper roll shaft 154. Spaced bearings 156 and 158 on the shaft 154 rotatably support bumper roll 160.

We provide our apparatus with means for driving the bumper roll 160 at the same speed as the guide rolls 120 and 138. A pulley 162 carried bY the bumper roll 160 for movement therewith receives a belt 164 which extends around a pulley 166 carried by the roll 120 for rotation therewith. A second pulley 168 on roll 120 at its end remote from the pulley 166 receives a belt 170 which engages a pulleY 172 secured to roll 138 for movement therewith. While we have shown an arrangement in which the bumper roll 160 is driven at the same speed as that at which the guide rolls are driven by the web, it is to be understood that it is not essential to the operation of our unwinder that the bumper roll be driven.

Figure 4:
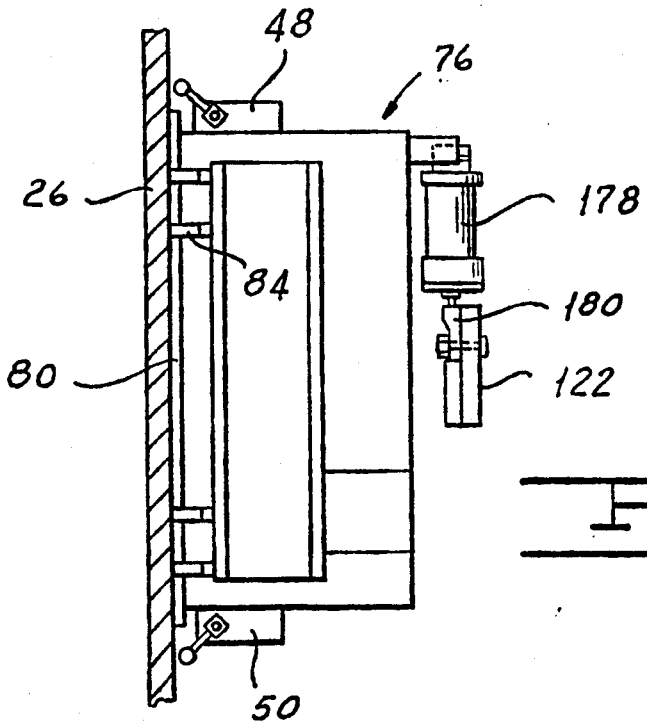
FIG. 4 is a fragmentary top plan of our flying splice unwinder taken along the line 4—4 of FIG. 3.
Figure 2:
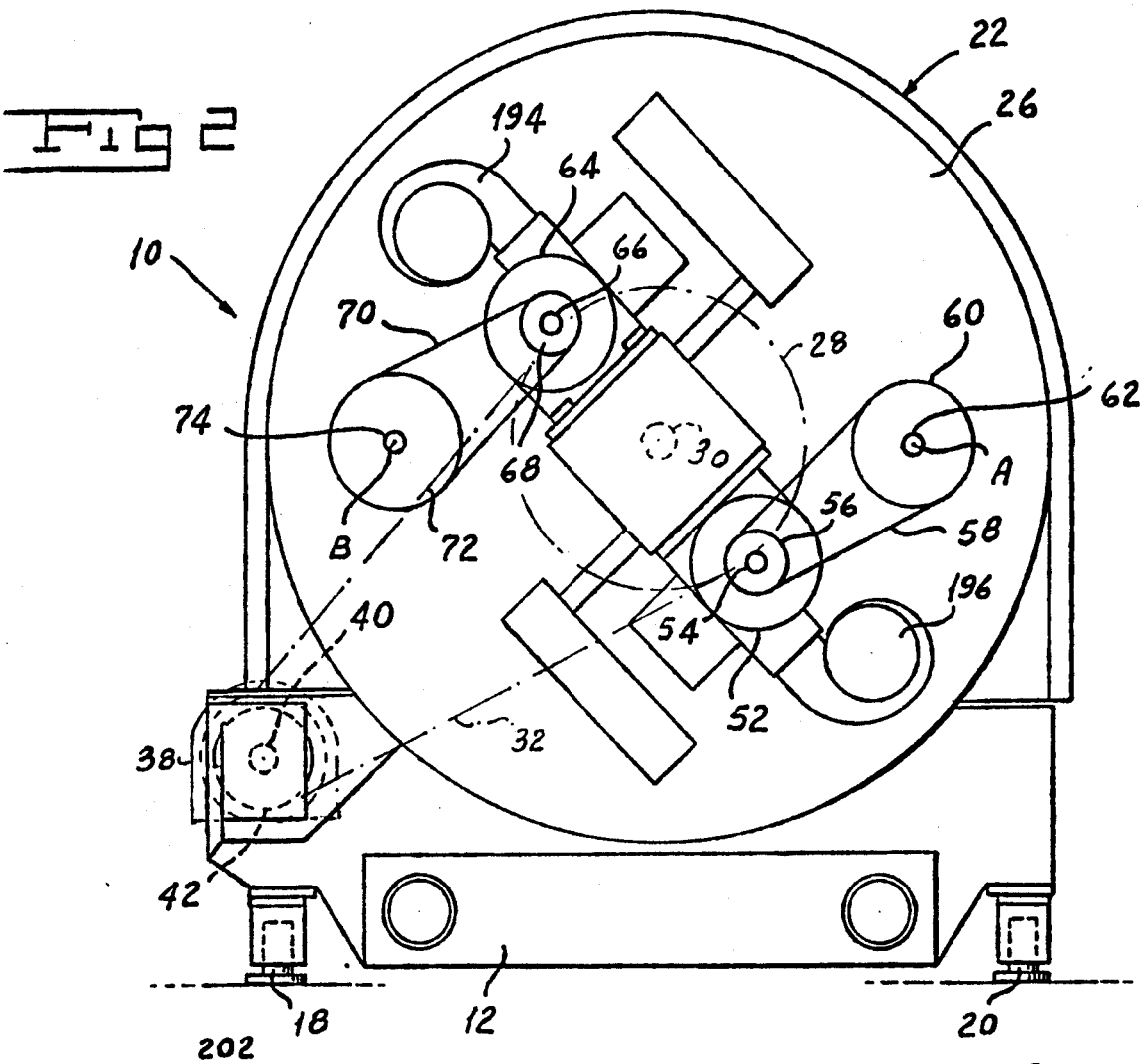
FIG. 2 is a rear elevation of our flying splice unwinder.

Referring to FIG. 4, we provide the left-hand carriage 76, for example, with a pair of limit switches 48 and 50 for indicating when the carriage is at the limits of its travel, to be described hereinbelow.

Figure 5:
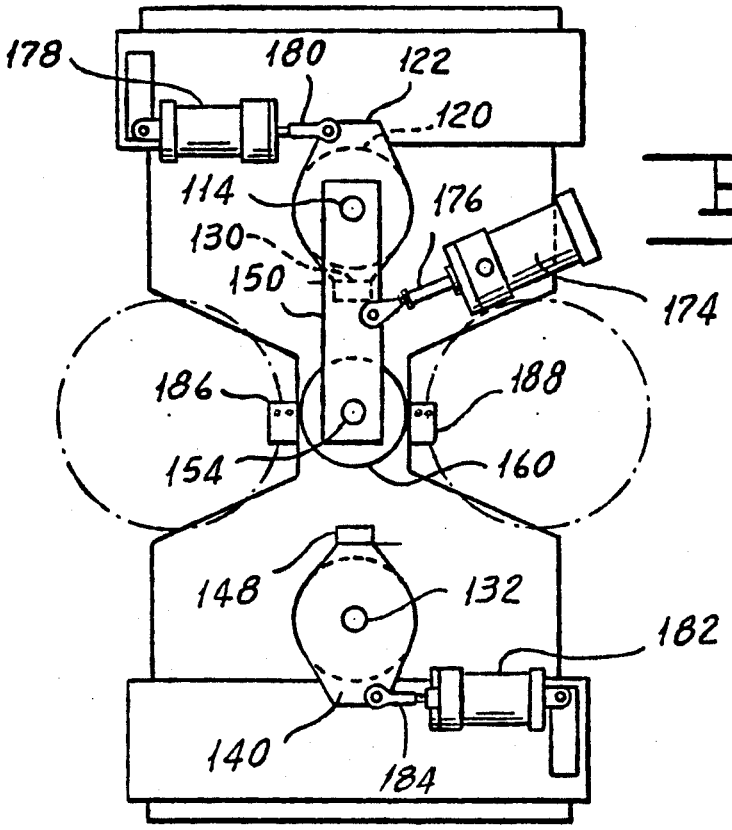
FIG. 5 is an end elevation of the splicing mechanism carriage of our flying splice unwinder.

Referring to FIG. 5, respective piston and cylinder assemblies, one assembly 174 of which is illustrated in the drawings, are adapted to be operated to move the bumper roll 160 toward or away from a fresh roll to which the trailing edge of the expiring web is to be spliced. Assembly 174 includes a piston rod 176 which is secured to the arm 150, for example. The assembly 174 may be a double-acting arrangement which may be operated either to swing bumper roll 160 in a clockwise direction or in a counterclockwise direction around a shaft 114.

A second pair of piston and cylinder assemblies, one assembly 178 of which is shown in the drawings, are adapted to be operated to actuate the knife bar 130. Assembly 178, for example, includes a piston rod 180 pivotally connected to the arm 122 of the two arms 122 and 124 which carry the knife bar 130. Similarly. a second pair of piston and cylinder assemblies, one assembly 182 of which is shown in the drawings, are adapted to be operated to actuate the knife bar 148. Assembly 182, for example, includes a piston rod 184 connected to the arm 140 which is one of the two arms 140 and 142 which support the knife bar 148.

Figure 6:
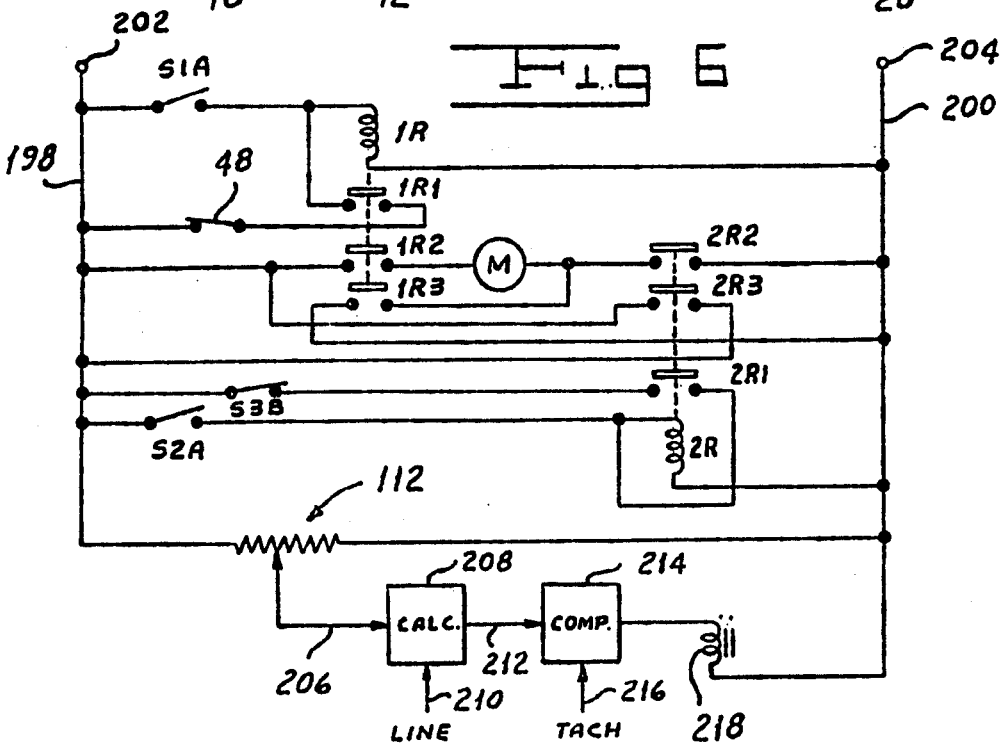
FIG. 6 is a schematic view of one form of electrical control circuit which can be used with our flying splice unwinder.

We provide the left-hand carriage 76, for example, with respective photo detectors 186 and 188 which are adapted respectively to stop the carriage at a point at which it is approximately ½ inch away from a new roll when the carriage is moving respectively to the right and to the left, as viewed in FIG. 6. It will readily be appreciated that this control is independent of the diameter of the new roll placed on the winder.

If desired, the knife bars 130 and 148 may be provided with webtail blow-off outlets 190 and 192. In such a case, blowers 194 and 196 may be mounted on the outside of plate 26 to provide a supply of air.

Referring now to FIG. 6, one form of control circuit which may be employed to control our flying splice unwinder includes respective conductors 198 and 200 connected to the terminals 202 and 204 a suable source of potential. A switch S1A is adapted to be operated to energize a relay winding 1R. In response, a first normally open switch 1R1 closes to complete the holding circuit for the winding through limit switch 48, for example. Concomitantly, switches 1R2 and 1R3 close to energize motor 96 to drive in one direction of rotation thereof. When the carriage reaches the limit of its movement in this direction, switch 48 opens to interrupt the holding circuit of winding 1R to cause the motor to stop. Closing a second switch S2A energizes a winding 2R to complete its own holding circuit through switch 2R1 and a switch S3B responsive to one of the photodetectors 186 or 188. At the same time, switches 2R2 and 2R3 close to energize motor 96 to drive in the reverse direction. Upon the approach of the bumper roll 160 to within approximately ½ inch of the new roll, the photo-detector 186 or 188 will open switch S3B to interrupt the holding circuit of winding 2R to cause the carriage to stop.

As has been pointed out hereinabove, potentiometer 112 puts out a voltage which is a measure of the displacement of the carriage from its limit position. For example, at the limit position at which switch 48 is opened, the potentiometer output will be zero. As it moves from this limit position toward the position at which switch S3B opens, the potentiometer voltage will be a measure of the diameter of the new roll.

This will readily be appreciated from a consideration of the operation of the potentiometer 112 as the carriage moves between its two limit positions, one adjacent the axis B and the other adjacent the axis A. Assuming that the potentiometer output signal is zero or a minimum with the carriage in its limit position adjacent to axis B and the potentiometer output a maximum in the limit position of the carriage adjacent to axis A, as the carriage moves from the B limit position toward the A limit position and is stopped as it approaches to within about ½ inch of a new roll positioned on axis A, the larger the reading of the potentiometer the smaller will be the diameter of the new roll. Conversely, in moving from the A limit position toward a new roll positioned on the B axis, the smaller the reading of the potentiometer the smaller will be the diameter of the roll.

In either of the two cases discussed hereinabove, the output of the potentiometer 112 is a measure of the diameter of the new roll. Knowing this diameter and the line speed, the rotational speed at which the new roll must be driven to bring its surface speed up to line speed can readily be calculated. Assuming, for purposes of simplicity, that the diameter of the new roll is $$\frac{20}{\pi}$$

feet, the circumference of the roll will be 20 feet. If the line speed is 1800 ft. per minute, then the new roll must be driven at 90 rpm to bring its surface speed up to line speed.

In our control circuit, we apply the output of the potentiometer 112 to a first input 206 of a calculating network or device 208. We apply a second voltage proportional to line speed to the second input 210 of the device 208. In response to the roll diameter signal input on line 206 and the line speed signal input at 210, the device 208 produces an output signal which is a measure of the speed in revolutions per minute at which the new roll must be driven in order to bring its surface speed up to line speed. It will be appreciated by those skilled in the art that the line speed signal can be obtained from any suitable measuring device associated with the line with which our unwinder is employed. In response to the diameter signal input at 206 and to the line speed signal input at 210, calculator 208 produces an output signal representative of the rotational speed at which the new roll must be driven in order to bring the surface thereof up to line speed. A measure of diameter can also be obtained from a proximity device such as an ultrasonic detector.

We apply the line speed rpm signal output from calculator 208 to one input terminal 212 of a comparator 214. A tachometer or the like (not shown) provides a measure of the actual rotational speed of the new roll. This signal is applied to a second input 216 of the comparator 214 so that the comparator produces an output signal when the new roll rotational speed equals the input signal at 212. The output signal from the comparator 214 may be employed, for example, to energize a solenoid 218 to operate a valve (not shown) to supply fluid under pressure to the piston and cylinder assembly 174 to swing the bumper roll 160 into engagement with the new roll.

Figure 7A:
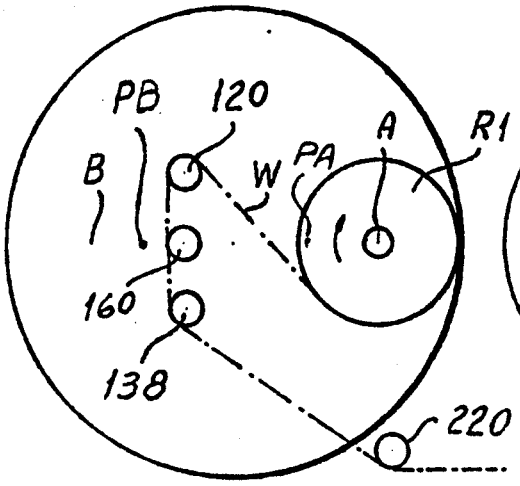
FIG. 7A is a diagrammatic view illustrating the relative positions of the parts of our flying splice unwinder in the course of an unwinding operation.
Figure 7C:
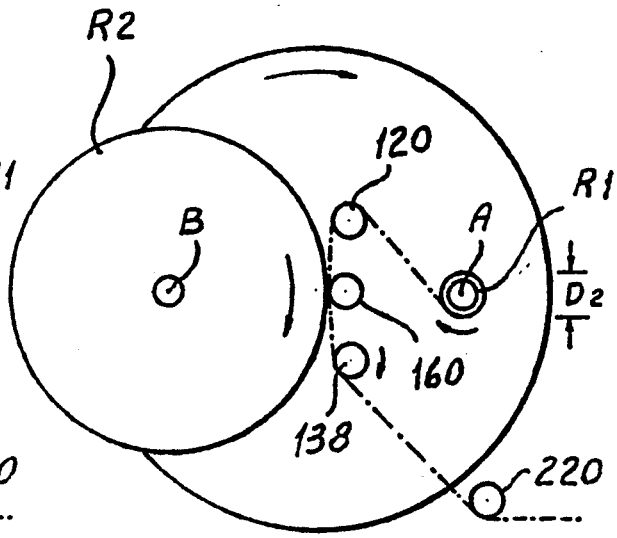
FIG. 7C is a diagrammatic view of our flying splice unwinder indicating the relative positions of the parts immediately following a splicing operation.

The operation of the form of our flying splice unwinder shown in FIGS. 1 to 6 can best be understood by reference to FIGS. 7A to 7D. As shown in FIG. 7A, the roll R1 being unwound is supported for rotary movement around the axis A. As the roll R1 rotates in a clockwise direction, the web W being unwound passes around guide roll 120 and guide roll 138 to an exit roll 220 from whence the web is directed toward the processing station or the like with which our unwinder is associated.

Control of our unwinder may be in response to signals indicating the diameter of the expiring roll. As is known in the art, the expiring roll may drive a pulse generator. Since, during an unwinding operation, the roll being unwound is always being driven at line speed, the number of pulses generated per unit time increase as roll diameter decreases. These signals may be used to initiate control operations.

Figure 7B:
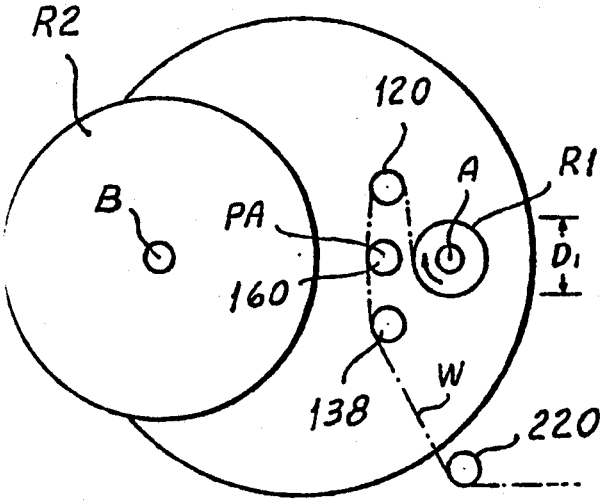
FIG. 7B is a diagrammatic view of our flying splice unwinder indicating the relative positions of the parts shortly before a splicing operation is performed.
Figure 7D:
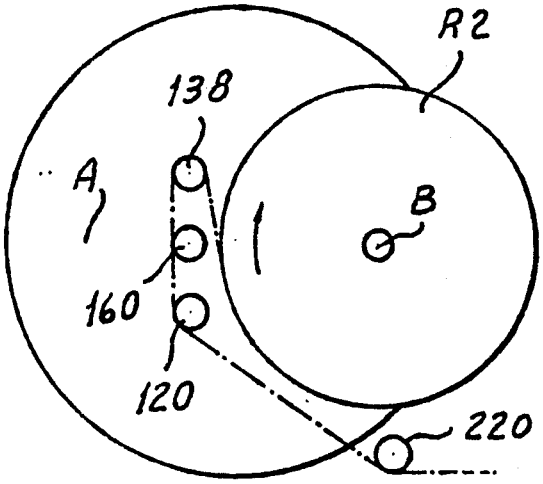
FIG. 7D is a diagrammatic view of our flying splice unwinder indicating the relative positions of the parts just after indexing.

When the roll R1 has wound down to a first predetermined degree which may, for example, be at the roll diameter D1, a signal represented by the closing of switch S1A energizes winding 1R to drive the carriage and the rolls 120, 160 and 138 toward the axis A until they reach a limit position indicated by the point PA in FIGS. 7A and 7B. At this time, limit switch 48 opens to interrupt the holding circuit of the winding 1R to cause the motor to stop. In this position of the carriage there is sufficient room on the turret to permit a fresh roll R2 to be mounted on the supports 46 aligned with axis B. This condition of the apparatus is illustrated in FIG. 7B.

When the winding R1 reaches a further unwind stage, as for example diameter D2 as determined by a suitable sensing device, the device puts out a signal represented by the closing of switch S2A in FIG. 6 to energize motor 96 (M) in the reverse direction to cause the carriage supporting roles 120, 138 and 160 to move from the limit position PA toward the axis B. When the carriage has moved to a position at which bumper roll 160 is approximately ½ inch from the surface of the new roll R2, sensor 186, for example, puts out a signal represented by the opening of switch S3B to interrupt the holding circuit of winding 2R to stop the motor. At the same time, motor 68 is energized to begin to drive the new roll R2. When the surface speed of the roll R2 reaches line speed, comparator 214 puts out an output signal to energize solenoid 218 to open a valve to supply fluid under pressure to the piston and cylinder assembly 174 to move bumper roll 160 into engagement with the new roll R2 to splice the new roll to the web W leaving the expiring roll R1. A predetermined time thereafter, fluid under pressure is supplied to the piston and cylinder 178 to actuate knife 130 to sever the web. The splicing operation is now complete and the core of the exhausted roll R1 can be removed. At this time the motor 36 may be energized to drive shaft 40 to index the turret 22 from the position shown in FIG. 7C to the position shown in FIG. 7D and the unwinding operation may continue. It will be seen that the roll 138 now occupies the position formerly occupied by roll 120 while roll 120 occupies the position formerly occupied by roll 138.

The unwinding operation continues until the new roll R2 is reduced to the diameter D1, for example, at which time the carriage motor is energized to move rolls 120, 138 and 160 to the limit position PB. The operation of splicing the web being exhausted to that carried by a new roll is carried out as before.

Figure 8:
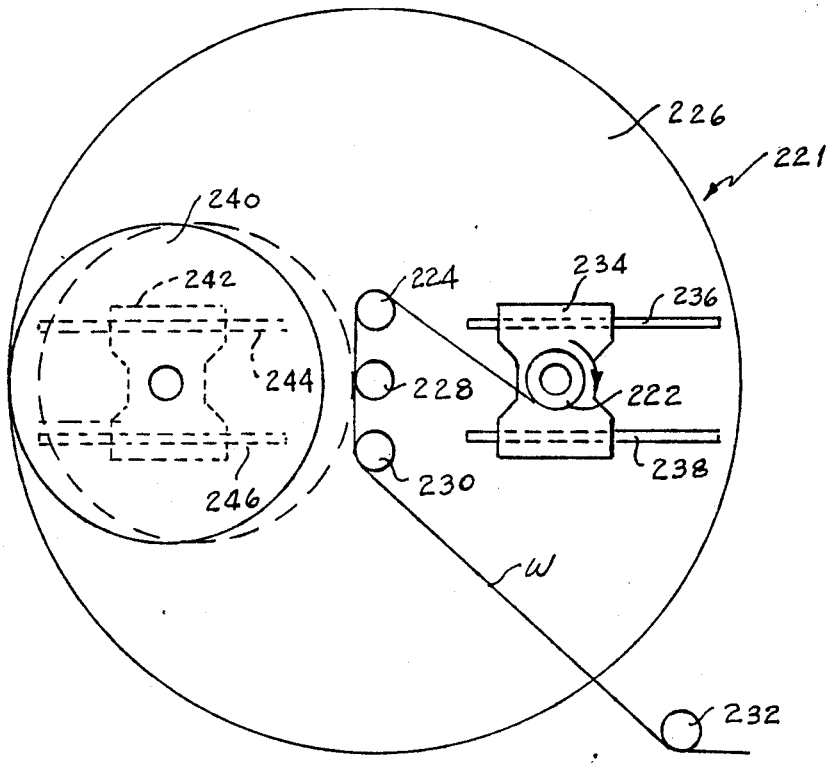
FIG. 8 is a schematic view of an alternate embodiment of our flying splice unwinder.

Referring now to FIG. 8, an alternate embodiment of our flying splice unwind is indicated generally by the reference character 221. In this embodiment of our invention, the web W being unwound from the expiring roll 222 passes first around an upper guide roll which is mounted for rotary movement in a fixed position on the turret, one end plate 226 of which is shown in FIG. 8. After leaving the guide roll 224, the web passes over the bumper roll 228 to a lower guide roll 230 rotatably mounted in a fixed position on the turret and then to a takeoff roll 232. The bumper roll 228 in this embodiment of our invention is not mounted for translatory movement on the turret but only for movement between a neutral position and its two operative positions.

In the form of our invention illustrated in FIG. 8, a new roll is mounted on the turret for translatory movement from a loading position to a ready position adjacent to the bumper roll 228 at which the splicing operation can take place. To this end, roll 222 is mounted on a carriage 234 supported for translatory movement along guide rails 236 and 238 on the turret. Similarly, a new roll 240 is mounted on a carriage 242 supported on the turret for translatory movement along rails 244 and 246. It will readily be appreciated that the carriages 234 and 242 are similar in construction and operation to the carriages which support the guide rolls 120 and 138 and the bumper roll 160 in the form of our invention illustrated in FIG. 1. The bumper roll 228 of FIG. 8 likewise may be actuated in the same manner as is the bumper roll 160 in the form of our invention shown in FIG. 1.

In operation of the unwinder 220 with the roll 222 being unwound approaching expiration, as shown in FIG. 8, a new roll 240 is loaded on the carrige 242 which is in its retracted position illustrated in full lines in FIG. 8. Just before a splicing operation is to take place, carriage 242 is driven along the guides 244 and 246 to the broken line position which it occupies during the splicing operation. After the splicing operation, the turret is indexed and carriage 234 is moved to its retracted position at which it is able to receive a fresh roll. Operations are then repeated in the manner described hereinabove.

Figure 9:
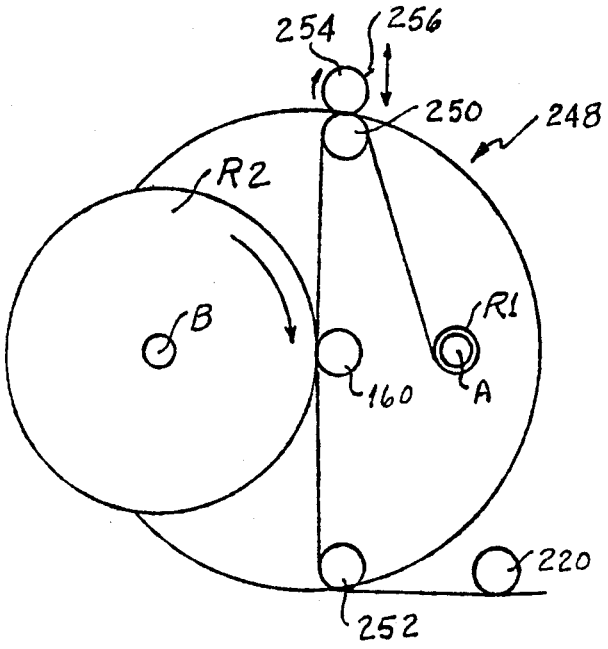
FIG. 9 is a schematic view of another form of our flying splice unwinder.

Referring now to FIG. 9, in a further form of our invention, indicated generally by the reference character 248, the bumper roll 160 is supported for movement on the turret in the same manner as in FIG. 1. In this embodiment of our invention, however, we provide guide rolls 250 and 252 which are mounted for rotary movement adjacent to the periphery of the turret. This enables us to use a rotary knife 254 having a blade 256 which is mounted off turret, as may in some instances be desirable.

Figure 10:
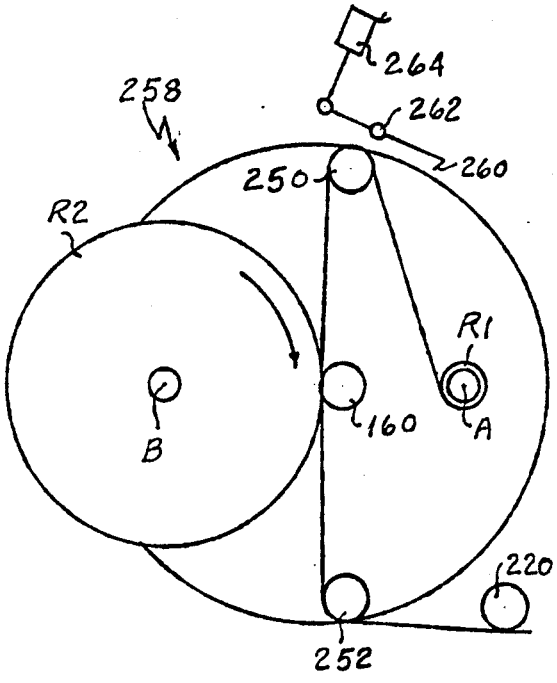
FIG. 10 is a schematic view of a further form of our flying splice unwinder.

Yet another form of our unwinder, shown in FIG. 10 and indicated generally by the reference character 258 is in most respects the same as the embodiment illustrated in FIG. 9. However, instead of using the rotary knife 254, in the form of our invention shown in FIG. 10, we employ a knife 260 supported for pivotal movement around a pivot 262 and adopted to be actuated by energization of a solenoid or the like 264. As in the form of our invention shown in FIG. 9, the knife 260 is mounted off turret.

Figure 11A:
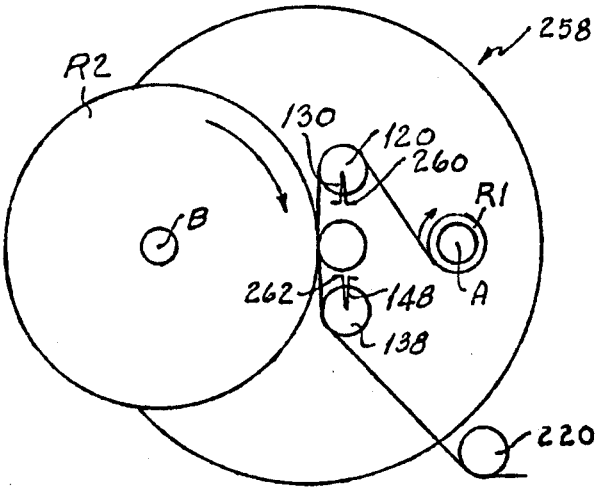
FIG. 11A is a schematic view of yet another form of our flying splice unwinder in one condition of its operation.
Figure 11B:
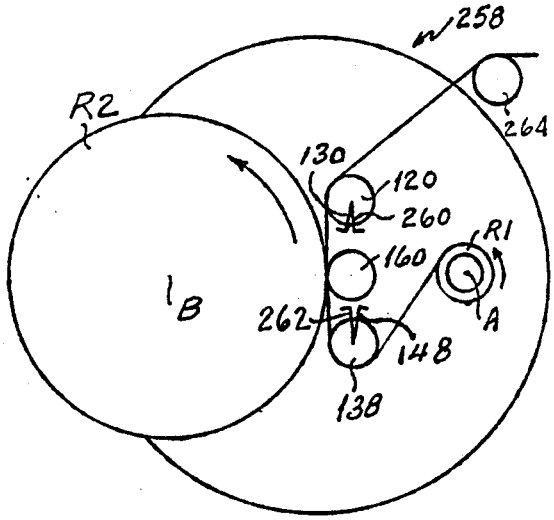
FIG. 11B is a schematic view of the form of our flying splice unwinder shown in FIG. 11A in another condition of its operation.

Referring now to FIGS. 11A and 11B, we have shown another form of our unwinder indicated generally by the reference character 258 which is capable of operating in both directions of unwind. As shown in FIG. 11A, when the roll R1 being unwound on the axis A rotates in a clockwise direction, the arrangement is the same as is illustrated in FIG. 1 and the knife 130 rotates in a clockwise direction in the course of the splicing operation. When the roll becoming exhausted is supported for rotary movement around the axis B, the knife 148 rotates in a clockwise direction in the course of the splicing operation.

As shown in FIG. 11B, when the roll being unwound around the axis A rotates in a counter-clockwise direction, a takeoff roller 264 is provided above the turret. In this condition of the apparatus, we provide a knife 262 which rotates in a counter-clockwise direction in the course of the splicing operation. As can be seen, the knife 262 rotates around the same axis as does knife 148 but in the opposite direction. When the roll being unwound is supported on the axis B, another knife 260 which rotates in a counter-clockwise direction around the same axis as does knife 130 is effective during the splicing operation.

It will be seen that we have accomplished the objects of our invention. We have provided an improved flying splice unwinder which does not include any off machine apparatus. Our improved flying splice unwinder incorporates the splicing mechanism as part of the unwinder turret. Our improved flying splice unwinder is compact. It is relatively inexpensive as compared with automatic splicing unwinders of the prior art. Our unwinder permits the splice to be made in any position of the turret with which the unwinder is associated.

It will be understood that certain features and subcombinations are of utility and may be employed without reference to other features and subcombinations. This is contemplated by and is within the scope of our claims. It is further obvious that various changes maY be made in details within the scope of our claims without departing from the spirit of our invention. It is, therefore, to be understood that our invention is not to be limited to the specific details shown and described.

Having thus described our invention, what we claim is:

1. Apparatus for continuously unwinding web material from a roll being unwound and from a fresh roll including in combination, a turret, first means on said turret for supporting a roll being unwound, second means on said turret for supporting a fresh roll, a bumper roll mechanism comprising a bumper roll for splicing the trailing end of said roll being unwound to the leading end of said fresh roll without interrupting the operation of unwinding said web from said roll being unwound and means mounting said bumper roll mechanism on said turret movement relative to said second supporting means between first position at which said bumper roll mechanism and said second supporting means are relatively remote from each other so that a fresh roll can be loaded on said second supporting means with the web being unwound passing between said bumper roll and said fresh roll and a second position at which said bumper roll mechanism and said second supporting means are relatively adjacent to each other so that a splicing operation can take place by said bumper roll moving said web being unwound into contact with the web on said fresh roll.

2. Apparatus as in claim 1 in which said second means is mounted in a fixed position on said turret and said bumper roll mechanism is mounted for movement on said turret for movement between said first and second positions.

3. Apparatus as in claim 1 in which said bumper roll mechanism is mounted in a fixed position on said turret and in which said second supporting means is mounted on said turret for movement between said first and second positions.

4. Apparatus as in claim 1 in which said splicing means comprises a knife mechanism adapted to be actuated to sever the web being unwound to form said trailing edge and means mounting said knife mechanism on said turret for movement with said bumper roll mechanism.

5. Apparatus as in claim 1 in which said splicing means comprises a knife mechanism adapted to be actuated to sever the web being unwound to form said trailing edge and means mounting said knife mechanism in an off turret position.

6. Apparatus as in claim 5 in which said knife mechanism comprises a rotating knife supported for translatory movement toward and away from the turret.

7. Apparatus as in claim 5 in which said knife mechanism comprises a knife and means mounting said knife for pivotal movement adjacent to said turret.

8. Apparatus for continuously unwinding web material from a roll being unwound and a fresh roll including in combination, a turret, first means on said turret for supporting a roll being unwound, second means on said turret for supporting a fresh roll and means on said turret for splicing the trailing end of said roll being unwound to the leading end of said fresh roll without interrupting said unwinding operation, said splicing means comprising a bumper roll, means mounting said bumper roll on said turret for movement between a retracted position remote from said fresh roll with the web being unwound passing between said bumper roll and said fresh roll and a fired position at which it moves said web being unwound into engagement with said fresh roll and means on said turret adapted to be actuated to move said bumper roll from said retracted position to said fired position.

9. Apparatus as in claim 8 in which said splicing means comprises means on said turret adapted to be actuated to sever the web being unwound to form said trailing edge and means for actuating said bumper roll moving means and said web severing means in timed relationship.

10. Apparatus as in claim 8 in which said bumper roll moving means comprises a carriage, means mounting said carriage on said turret for movement between limit positions respectively adjacent said first and second supporting means, means mounting said bumper roll on said carriage for movement between an idle position remote from said fresh roll and said fired position and means on said carriage adapted to be actuated to move said bumper roll from said idle position to said fired position.

11. Apparatus as in claim 10 in which said splicing means comprises means on said carriage adapted to be actuated to sever the web being unwound to form said trailing edge and means for actuating said bumper roll moving means and said severing means in predetermined timed relationship.

12. Apparatus for continuously unwinding web material from a plurality of rolls of web material including in combination, a turret, first means on said turret for supporting a first roll of web material being unwound for rotary movement around a first axis, second means on said turret for supporting a fresh roll of web material for rotary movement around a second axis spaced from said first axis, a carriage, means mounting said carriage on said turret for movement relative thereto toward and away from said first axis, a bumper roll, means mounting said bumper roll on said carriage for movement relative thereto between an inactive position and an active position at which it can engage a web positioned adjacent thereto, a knife, means mounting said knife on said carriage for movement relative thereto between an inactive position and an active position at which it can sever a web positioned adjacent thereto, said web being unwound extending adjacent to said bumper roll in the course of an unwinding operation, means for moving said carriage to position said web being unwound in closely spaced relationship to said fresh roll in preparation for a splicing operation, means on said turret for driving said fresh roll to bring the surface speed thereof up to the speed of the web being unwound, means for moving said bumper roll to said fired position to bring said web being unwound into contact with the web on said fresh roll and means for moving said knife to said fired position to sever said web being unwound.

13. Apparatus as in claim 12 in which said carriage moving means comprises means adapted to be energized to drive said carriage in a direction toward said second axis, means on said carriage for sensing the presence of a fresh roll, and means responsive to said sensing means for interrupting said drive means.

14. Apparatus as in claim 13 including means for producing a first signal representing the position of said carriage, means for producing a second signal representing the speed of said fresh roll and means responsive to said first and second signals for actuating said bumper roll moving means and said knife moving means in predetermined timed relationship when said fresh roll reaches the line speed of the roll being unwound.

15. Apparatus for continuously unwinding web material from a succession of rolls including in combination, a turret, means on said turret for supporting a roll for rotary movement around a first axis, means on said turret for supporting a roll for rotary movement around a second axis spaced from and generally diametrically opposite to said first axis, a bumper roll, a support, means mounting said bumper roll on said support for movement relative thereto between a retracted position and an active position, means mounting said support on said turret for movement relative thereto between a first position adjacent to said first axis at which a fresh roll can be mounted on said second axis roll supporting means and a second position adjacent to said second axis at which a fresh roll can be mounted on said first axis roll supporting means.

16. Apparatus as in claim 15 in which said support comprises a carriage, means mounting said carriage on said turret for movement along a path between said axes, and means mounting said bumper roll on said carriage for movement from an idle neutral position to a first active position at one side of said neutral position with reference to a fresh roll supported on said first axis and a second active position at the other side of said neutral position with reference to a fresh roll supported on said second axis.

17. Apparatus for continuously unwinding web material from a plurality of rolls of web material including in combination, a turret, means mounting said turret for movement around a turret axis, respective means on said turret for supporting rolls for movement around spaced first and second unwinding generally diametrically opposite first and second axes on said turret, a carriage, means mounting said carriage on said turret for movement relative thereto between a first limit position adjacent to said first unwinding axis and a second limit position adjacent said second unwinding axis, a bumper roll, means mounting said bumper roll on said carriage for movement from a neutral position to a first active position to one side of said neutral position and at which it moves a web being unwound from a roll on said second unwinding axis into engagement with a fresh roll on said first unwinding axis and to a second active position to the other side of said neutral position and at which it moves a web being unwound from a roll on said first unwinding axis into engagement with a fresh roll on said second unwinding axis, first knife means, means mounting said first knife means on said carriage for movement relative thereto from a rest position to an active position displaced from its rest position and at which it severs a web being unwound from a roll on said second unwinding axis, second knife means, means mounting said second knife means on said carriage for movement relative thereto from a rest position to an active position displaced from its rest position and at which it severs a web being unwound from a roll on said first unwinding axis, and control means for moving said bumper roll to its first active position and said first knife means to its active position during a first web transfer operation and for moving said bumper roll to its second active position and said second knife means to its active position in the course of a second web transfer operation.

18. Apparatus as in claim 17 including a first and second guide rolls, means mounting said guide rolls on said carriage for rotary movement around axes located on opposite sides of said bumper roll.

19. Apparatus as in claim 18 in which said first and second knife means are respective first and second knife bars, said first and second knife means mounting means comprising means for mounting said knife bars for pivotal movement around the respective guide roll axes.

20. Apparatus as in claim 19 in which said control means comprises first means on said carriage for sensing the presence of a fresh roll on said first axis and second means on said carriage for sensing the presence of a fresh roll on said second axis.

21. Apparatus as in claim 17 in which said control means comprises means adapted to be energized to drive said carriage, means for energizing said drive means to move said carriage to said first limit position when a roll on said first axis is unwound to a certain extent to permit a fresh roll to be loaded on said second axis supporting means, means for energizing said drive means to move said carriage toward said second axis when said roll on said first axis is unwound to a greater extent, means on said carriage for sensing the presence of a fresh roll on said second axis supporting means, means on said turret adapted to drive said fresh roll, means responsive to said sensing means for interrupting said carriage drive and for energizing said fresh roll driving means, means for producing a first signal representing the position of said carriage, means for producing a second signal proportional to the speed of said fresh roll, and means responsive to said first and second signals for moving said bumper roll to its second fired position and for moving said second knife to its fired position to complete a splice to permit the roll to be removed from said first roll supporting means so that said turret can be indexed and said fresh roll is a roll being unwound on said second axis.

22. Apparatus as in claim 21 in which said control means comprises means for energizing said drive means to move said carriage to said second limit position when said roll on said second axis is unwound to a certain extent to permit a second fresh roll to be loaded on said first axis supporting means, means for energizing said drive means to move said carriage toward said first axis when said roll on said second axis is unwound to a greater extent, second sensing means on said carriage for sensing the presence of a fresh roll on said first axis supporting means, means on said turret adapted to drive said second fresh roll, means responsive to said second sensing means for interrupting said carriage drive and for energizing said second fresh roll driving means, said carriage position signal producing means producing a third signal, means for producing a fourth signal proportional to the speed of said second fresh roll and means responsive to said third and fourth signals for moving said bumper roll to its first fired position and for moving said first knife to its fired position.

23. Apparatus for unwinding web material from a roll including in combination, a turret, means on said turret for supporting a roll to be unwound for rotary movement around an axis, a bumper roll, a support, means mounting said bumper roll on said support for movement relative thereto between a retracted position and an active position at which it can engage a roll positioned adjacent thereto and means mounting said support on said turret for movement relative thereto between a first position relatively remote from said axis at which a fresh roll can be mounted on said supporting means and a second position adjacent to said roll to be unwound at which said bumper roll can be moved to its active position.

24. Apparatus for continuously unwinding web material from rolls including in combination, a turret, first roll support means on said turret, second roll support means on said turret, a splicing mechanism comprising a bumper roll and means mounting said splicing mechanism on said turret for movement relative to said second roll support means between a first relatively remote position at which a fresh roll can be loaded on said second roll support means with said web being unwound passing between said bumper roll and said fresh roll and a second relatively adjacent position at which a splicing operation can take place by said bumper roll moving said web being unwound into contact with the web on said fresh roll for joining the web from a fresh roll on said second roll support means to the web being unwound from an expiring roll on said first support means, said splicing mechanism comprising a first knife, means mounting said first knife on said turret for movement relative thereto to sever the web being unwound from an expiring roll on said first roll support means in a first direction, a second knife and means mounting said second knife on said turret for movement relative thereto to sever the web being unwound from an expiring roll on said first roll support means in the direction opposite to said first direction.

25. Apparatus as in claim 24 in which said first and second knives move in opposite directions in the course of a severing operation.

26. Apparatus as in claim 24 in which each of said knives moves in the direction of unwinding.

27. Apparatus as in claim 26 in which said first and second knives move in opposite directions.

28. Apparatus as in claim 24 including means mounting said splicing mechanism and said first roll support means for relative movement between a first relatively remote position at which a fresh roll can be loaded on said first means and a second relatively adjacent position at which a splicing operation can take place for joining the web from a fresh roll on said first roll support means to the web being unwound from an expiring roll on said second roll support means, said splicing mechanism comprising a third knife, means mounting said third knife on said turret for movement relative thereto to sever the web being unwound from an expiring roll on said second roll support means in said first direction, a fourth knife, and means mounting said fourth knife on said turret for movement relative thereto to sever the web being unwound from an expiring roll on said second roll support means in said opposite direction.

29. Apparatus as in claim 28 in which the direction of movement of said first and third knives is opposite to the direction of movement of said second and fourth knives.

30. Apparatus as in claim 28 in which each of said knives moves in the direction of unwinding.

31. Apparatus as in claim 30 in which the direction of movement of said first and third knives is opposite to the direction of movement of the second and fourth knives.

32. Apparatus for continuously unwinding web material from rolls including in combination, a turret, first roll support means on said turret, second roll support means on said turret, a splicing mechanism comprising a bumper roll and means mounting said splicing mechanism on said turret for movement relative to said second roll support means between a first relatively remote position at which a fresh roll can be loaded on said second roll support means with said web being unwound passing between said bumper roll and said fresh roll and a second relatively adjacent position at which a splicing operation can take place by said bumper roll moving said web being unwound into contact with the web on said fresh roll for joining the web from a fresh roll on said second roll support means to the web being unwound from an expiring roll on said first support means, said splicing mechanism comprising a guide roll rotatable around an axis, a knife bar and means mounting said knife bar for movement around said axis.

33. Apparatus as in claim 32 in which said splicing means comprises and means mounting said bumper roll for swinging movement around said axis between active and inactive positions.

* * * * *